US005848698A

United States Patent [19]

Stompe

[11] Patent Number: 5,848,698

[45] Date of Patent: Dec. 15, 1998

[54] LITERATURE HOLDER AND BLANK THEREFORE

[76] Inventor: Brian Keating Stompe, 110 San Mateo Way, Novato, Calif. 94945

[21] Appl. No.: 783,532

[22] Filed: Jan. 14, 1997

Related U.S. Application Data

[63] Continuation-in-part of Ser. No. 430,761, Apr. 27, 1995, Pat. No. 5,695,061.

[51] Int. Cl.[6] ..... B65D 85/48; A47H 1/04

[52] U.S. Cl. ..... 206/449; 40/661.03; 40/661.08; 206/576; 211/70.1; 211/90; 211/94; 248/205.3; 248/223.41

[58] Field of Search ..... 206/449, 576; 211/50, 55, 70.1, 90, 94; 248/205.3, 214, 217.4, 223.41, 911; 40/661.03, 661.08

[56] References Cited

U.S. PATENT DOCUMENTS

| | | | |
|---|---|---|---|
| 1,331,682 | 2/1920 | Smith | 211/55 X |
| 1,459,538 | 6/1923 | Klatt | 211/55 X |
| 2,283,546 | 5/1942 | Fischer | 211/55 X |
| 2,333,717 | 11/1943 | Heed et al. | 211/50 X |
| 2,755,576 | 7/1956 | Golden | 248/205.3 |
| 3,023,929 | 3/1962 | Stein | 206/494 X |
| 3,178,138 | 4/1965 | Hessdoerfer et al. | 248/205.3 X |
| 3,744,623 | 7/1973 | Woofter | 248/205.3 X |
| 4,016,977 | 4/1977 | Krautsack | 248/205.3 X |
| 4,215,840 | 8/1980 | Babberl | 248/214 X |
| 4,301,987 | 11/1981 | Conway | 248/221.4 |
| 4,420,082 | 12/1983 | Bernie | 248/220.3 X |
| 4,630,731 | 12/1986 | Albery | 211/50 X |
| 4,678,151 | 7/1987 | Radek | 211/94 X |
| 4,828,121 | 5/1989 | Willocks, Jr. | 211/94 |
| 5,042,768 | 8/1991 | Goldstein | 248/225.1 |

*Primary Examiner*—Bryon P. Gehman

[57] ABSTRACT

Improvements may be incorporated in the literature holder and blank therefor which allow it to firmly hold upright for display one or two pieces of literature without support of a bottom panel, and which improvement provides a more economical blank, and provides access for insertion and withdrawal of literature from two open sides of the assembled holder; as well as an improvement which allows the blank and literature holder formed from it to dispense literature from the top of, or from the front of the holder; and an improvement which enables the blank and literature holder assembled therefrom to reduce space required by the holder.

8 Claims, 13 Drawing Sheets

LITERATURE HOLDER AND BLANK THEREFORE

This is a continuation-in-part of prior application Ser. No. 08/430,761, filed Apr. 27, 1995, now U.S. Pat. No. 5,695,061.

BACKGROUND OF THE INVENTION & DESCRIPTION OF PRIOR ART

1. Field of Invention

This invention relates to, "Literature Holder and Blank Therefore", with improvement described herein which enables the blank and literature holder formed therefrom, to display one or two pieces of literature, held firmly pressed between two side panels, upright at 90 degrees to the surface to which the literature holder is attached and which said literature holder provides two openings from which literature may be removed from it and replaced with new literature, and which blank from which said holder is formed is economical of material required for its construction; and with improvement to provide a literature holder and blank therefore from which literature may be dispensed from either the open top or open end of the holder while, displaying said literature at 90 degrees from the surface to which the holder is attached; and improvement which provides economy of space between the surface to which the holder is attached and the front of the holder assembled from the blank.

2. Description of Prior Art

The Store Shelf Literature Holder and Blank Therefore is constructed to attach to store pricing channel, which fronts store shelves, or to attach to a vertical surface with horizontal opening, which surface is known as "slat wall", to attach to a vertical surface with holes spaced with horizontal centers a uniform distance apart, known as peg board, by means of pegs, and when attached to these or other surfaces, displays literature supported by a bottom panel or panels, which literature is held upright by two side panels.

It would offer convenience in displaying only one or two thin pieces of literature which are not being dispensed from the holder, but are being held in place by the holder for display of said literature, if said literature could be placed or replaced in the holder formed from the blank by placing the literature between two side panels which would hold it firmly upright and in place without requiring a bottom panel to support it. It would be more economical of material required to produce the blank if a bottom panel or panels were not required for the blank or holder.

In other instances, when the holder is constructed with a bottom panel to support literature, it may be preferable if literature held in the holder, could be dispensed from either the top of the literature holder or from the side of the holder facing away from the surface to which the holder is attached, which side faces people who may be in front of the holder, rather than providing access to the literature from the top of the holder only.

It would also be preferable in some instances, if the holder took a minimum of space between the surface to which it is attached and it's extension 90 degrees from that surface.

SUMMARY OF THE INVENTION

Accordingly it is an object to provide improvement to this literature holder and blank therefore which will enable it to firmly hold upright one or two pieces of literature without support of a bottom panel, facilitating removal and replacement of said piece or pieces of literature and providing a more economical blank. It is an object to provide improvement that will permit said literature holder and blank therefore to support literature from below while permitting withdrawal of the literature from two openings. It is the object to provide improvement which will reduce the space required for said holder assembled from a blank, between the surface to which said holder is attached and the termination of said holder at 90 degrees to said surface. Other objectives and advantages of the improvements which may be made to this invention will become apparent upon reading the following detailed description and reference to drawings.

DETAILED DESCRIPTION OF PREFERRED EMBODIMENT

Figure 1:
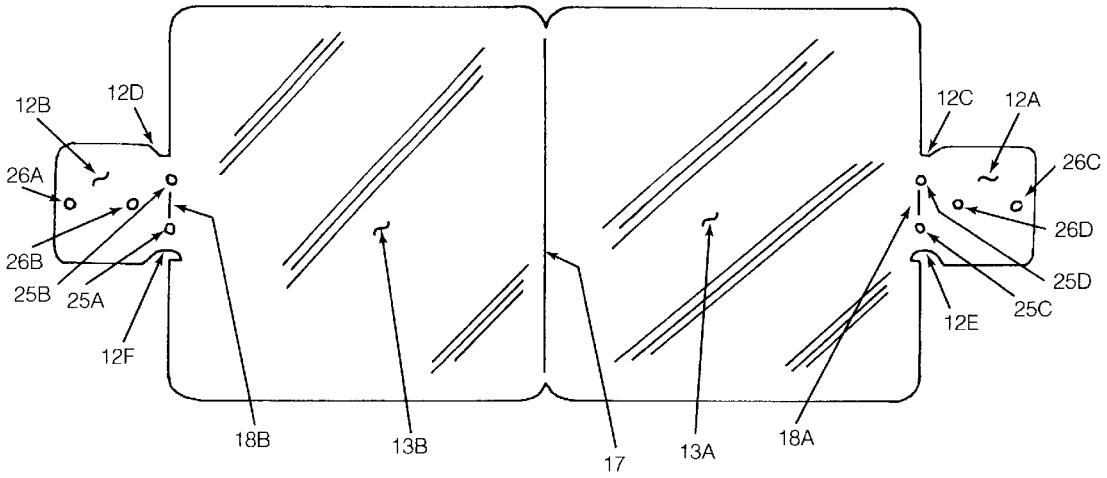
FIG. 1 shows the exterior view of a blank for a literature holder which will display one or two pieces of thin literature, which may be inserted or withdrawn from the top or from the bottom of the assembled holder, at 90 degrees to the display surface to which the holderm may be attached.
Figure 4:
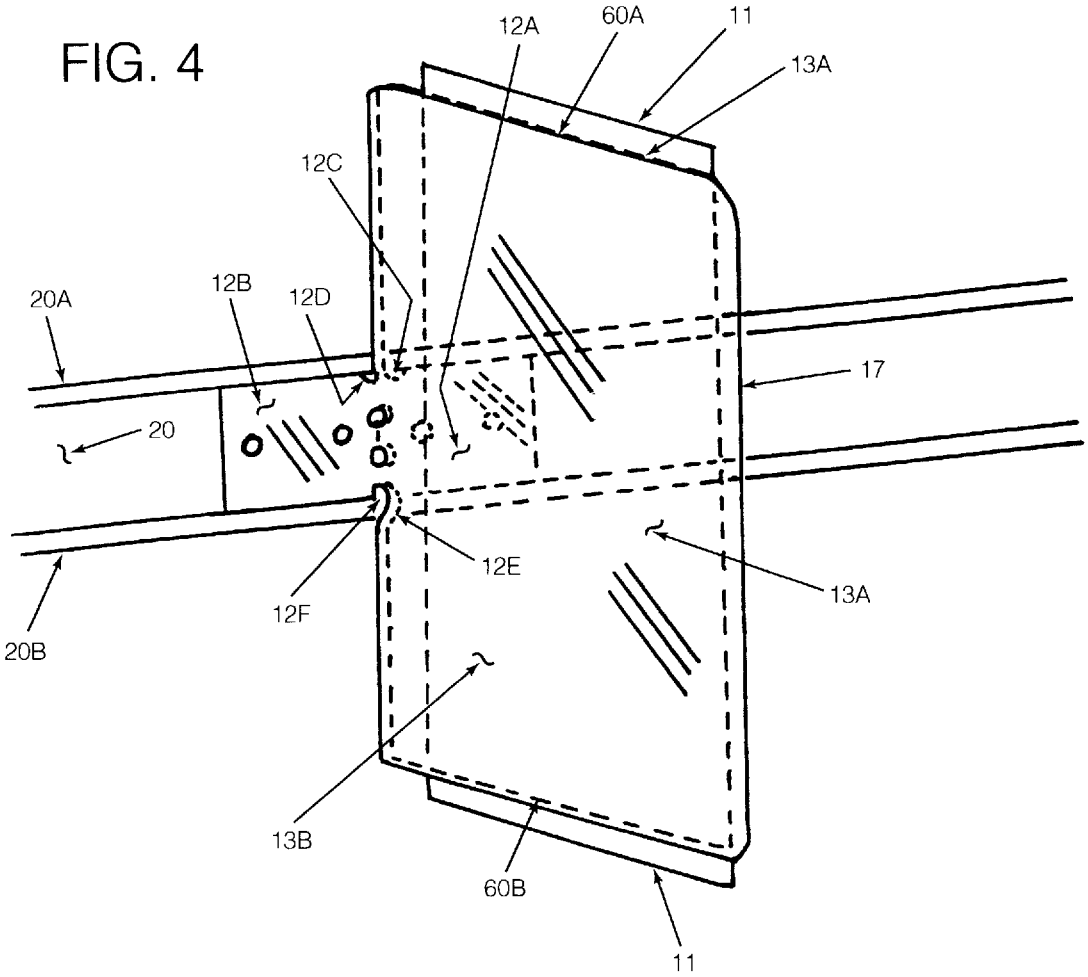
FIG. 4 shows a literature holder attached to store shelf pricing channel with a thin piece of literature held in the holder, which literature extends from the top and bottom openings of the holder and is held at 90 degrees to the store shelf.
Figure 5:
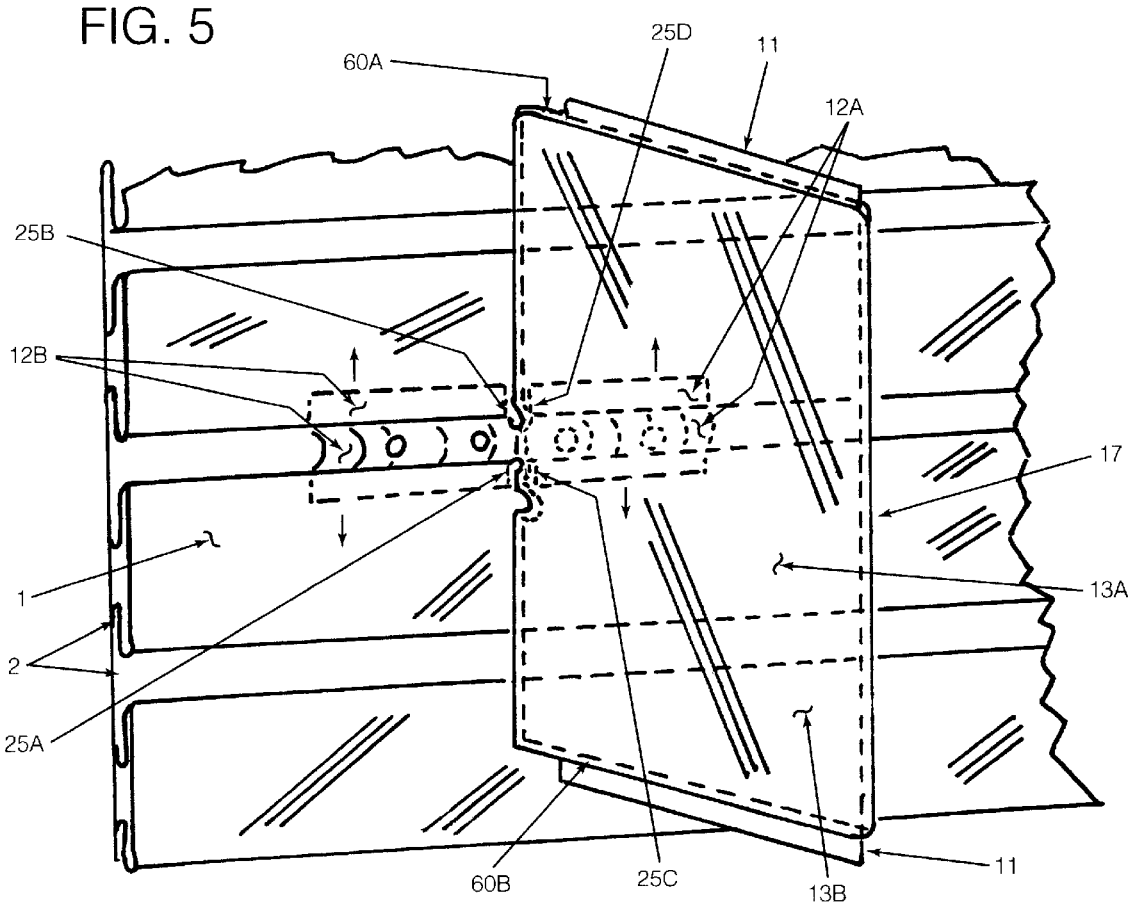
FIG. 5 shows a literature holder attached to slat wall with a thin piece of literature held in the holder, which literature extends from the top and bottom openings of the holder and is displayed at 90 degrees from the slat wall surface.
Figure 6:
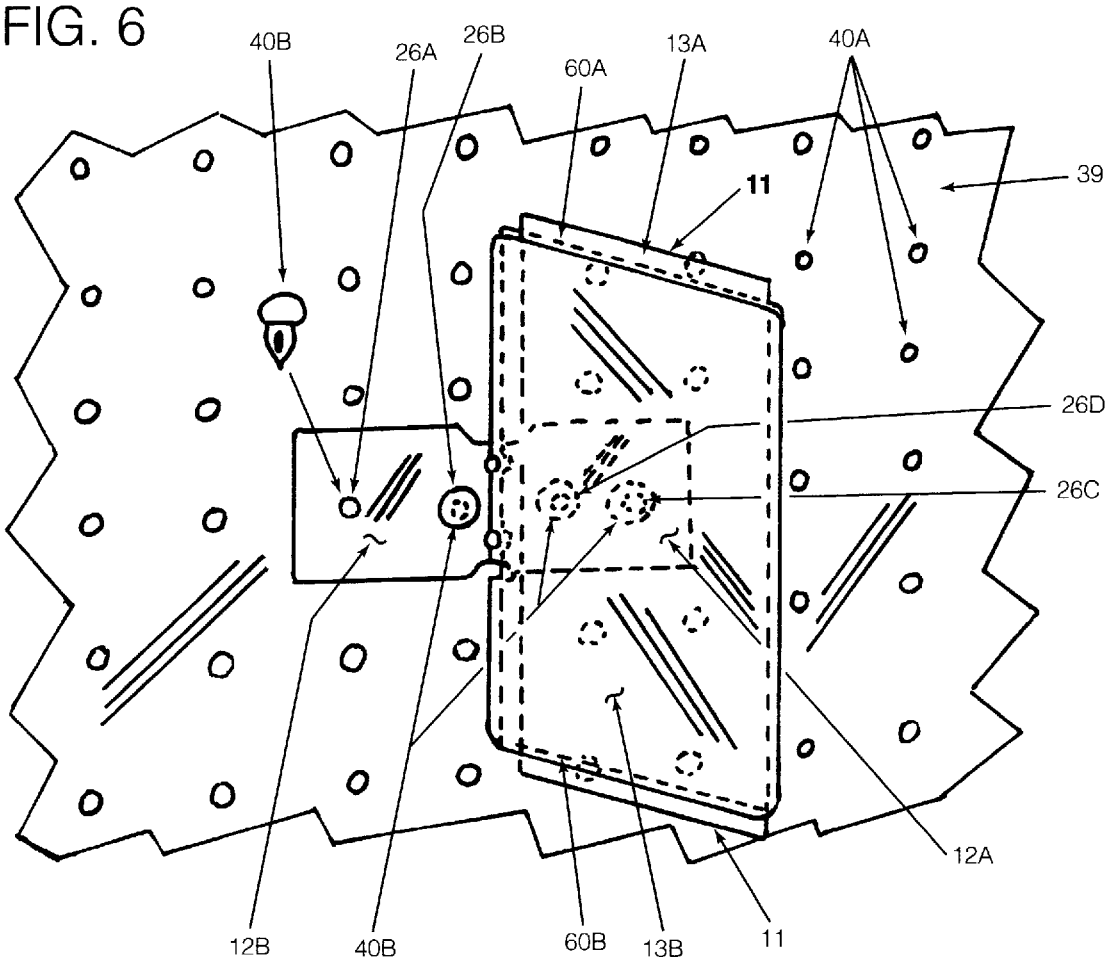
FIG. 6 shows a literature holder attached to peg board with a thin piece of literature held in the holder, which literature extends from the top and bottom openings of the holder and is displayed at 90 degrees to the peg board surface.

Turning to the figures of the drawing, there is seen in FIG. 1, the exterior view of a blank made of thin stiff plastic material, cut so it may be folded with the interior sides folding to meet each other, which fold is commonly done with heat applied to the area at which the plastic material is folded to insure upon folding that the material retains it's folded form, and which fold is on an axis illustrated by 17, which causes the side panels, illustrated by 13B and 13A to meet, touching each other, and to remain touching each other after they are folded, as illustrated in FIG. 4, with shelf strip panels, 12A and 12B opposite each other; so that in keeping with an objective of the literature holder, one or two thin pieces of literature may be inserted between side panels 13B and 13A if the panels are parted for insertion of the literature, and if the literature, as illustrated by 11 in FIG. 4, is inserted with one edge close to where the side panels meet at 17, so that when sides 13B and 13A are released, said sides will come together, pressing the literature between them with the edge of the literature impinged near where said sides meet at 17, thus holding said literature upright for display at 90 degrees from a display surface, such as the store pricing channel illustrated by 20 in FIG. 4, to which the holder may be attached, or as attached to slat wall illustrated by FIG. 5, or as attached to peg board illustrated by FIG.6.

As illustrated in FIGS. 4,5,and 6, literature, illustrated by 11, may be grasped at the top opening of the holder, illustrated by 60A, or at the bottom opening of the holder, illustrated by 60B, so that if the literature is pulled, it can be removed from the top or from the bottom of the holder formed from the blank of FIG. 1.

FIG. 4, illustrates how the holder may be attached to store pricing channel, illustrated by 20, when the shelf strip panel 12B is folded at score 18B at 90 degrees to side panel 13B and shelf strip panel 12A is folded at score 18A at 90 degrees to side panel 13A, which enables the holder be attached to store pricing channel 20 by engaging the edges of shelf strips 12B and 12A under pricing channel chines 20A and 20B, and how the two angled cuts at 12C and 12D, work in combination with the two cut outs shaped like the shelf channel chine, 12E and 12F , on panels 12A and 12B, to assume an optimum attitude when the holder is attached to the pricing channel, for presentation of literature which may be held in the holder for viewing at 90 degrees from the shelf.

Figure 9:
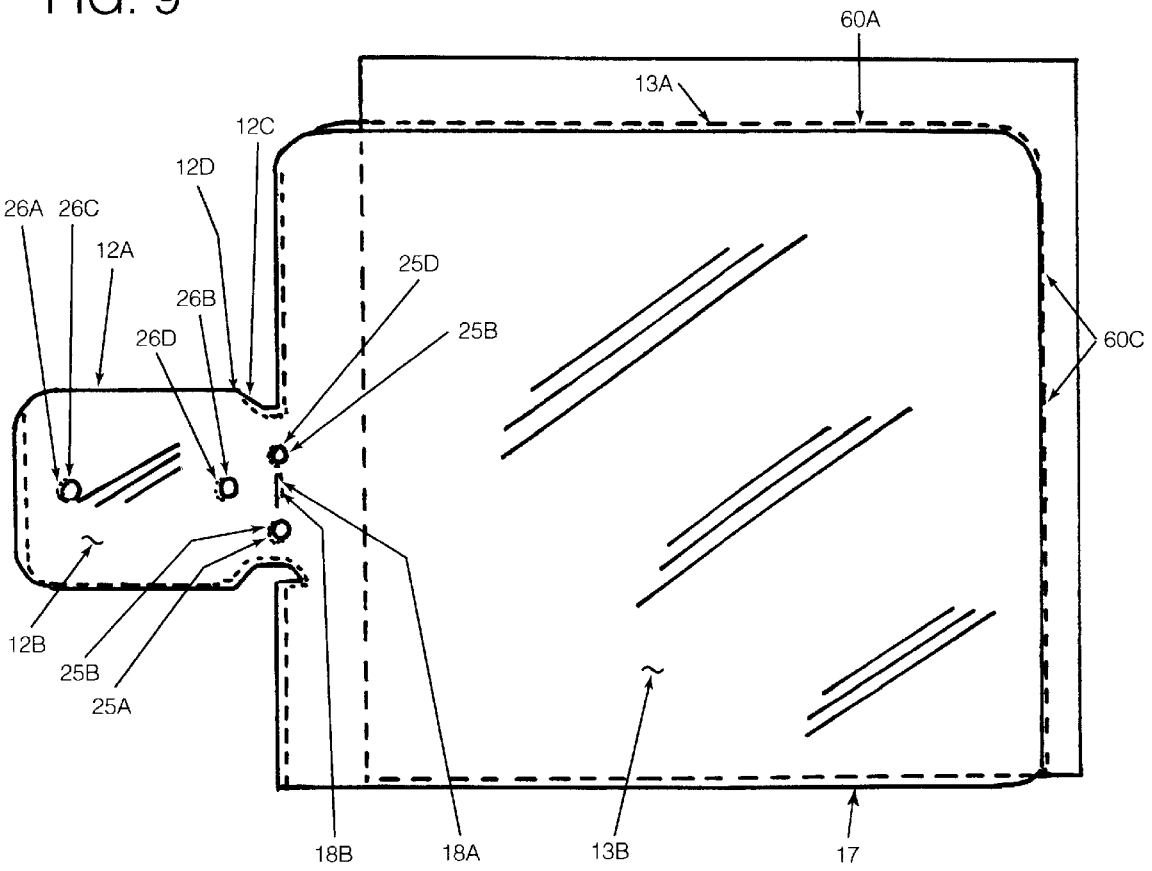
FIG. 9 shows an assembled literature holder in which a thin piece of literature, has been inserted and which literature extends from the top and from the front of the holder, for ease of withdrawal from either the top or front of the holder when it is leveraged at 90 degrees to a display surface.
Figure 11:
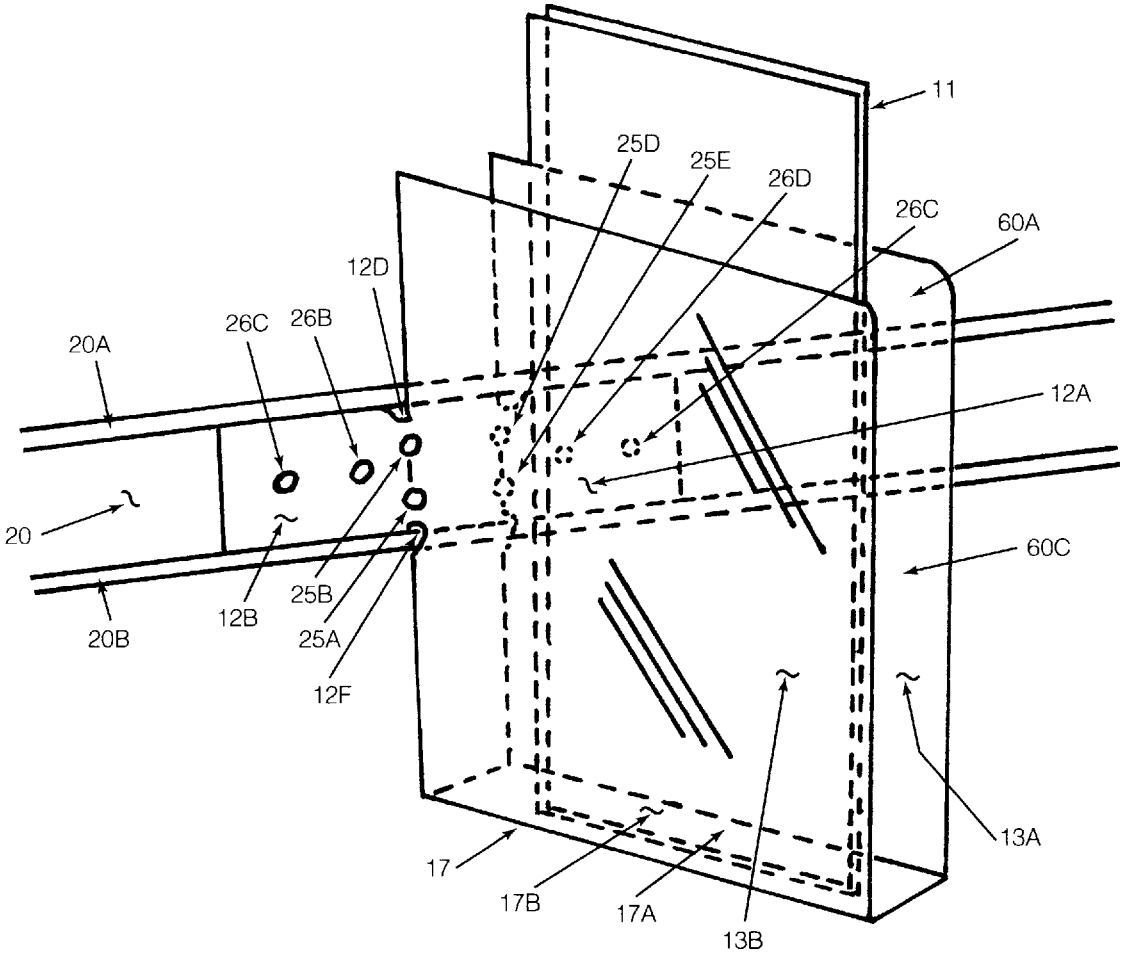
FIG. 11 shows an assembled literature holder displaying literature at 90 degrees to store pricing channel, from which holder literature may which may be withdrawn from either the top or the front of the holder.
Figure 13:
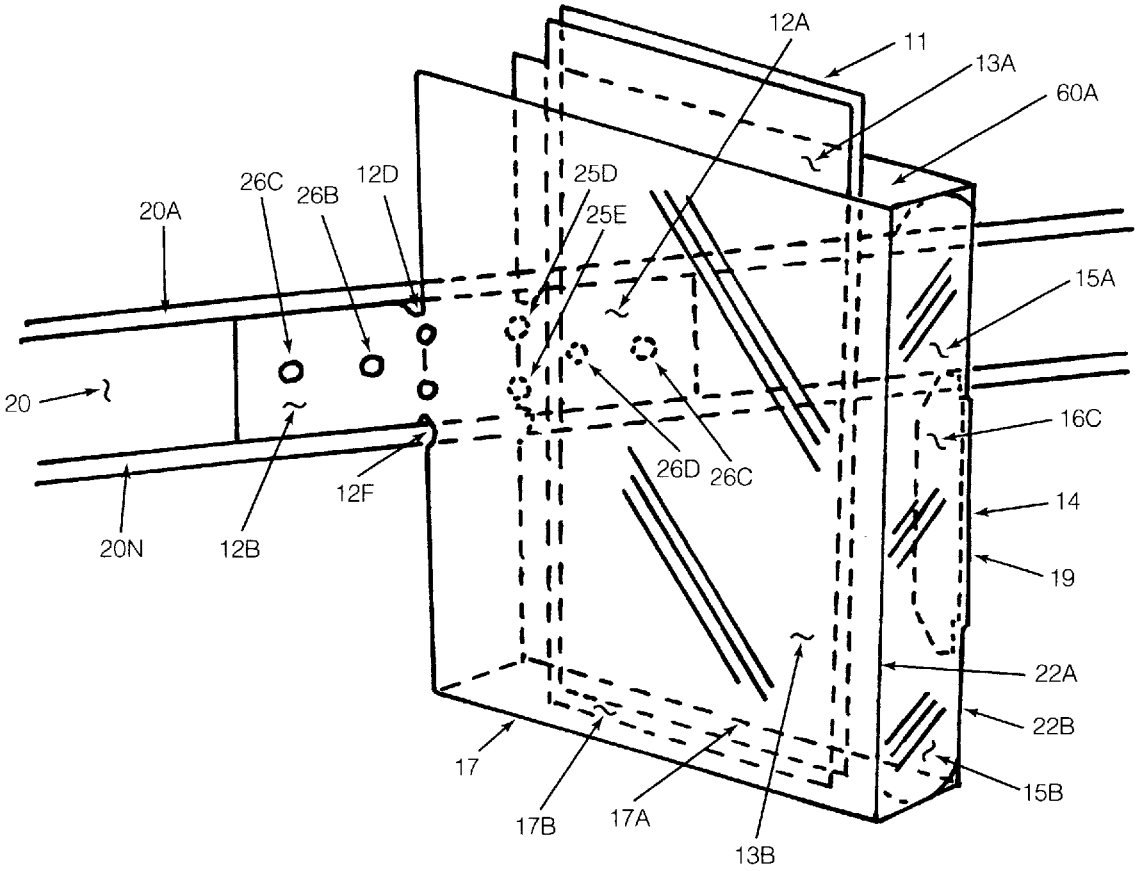
FIG. 13 shows a holder displaying literature at 90 degrees to a store shelf pricing channel, in a manner conservative of space between the display surface and the termination of the holder.

Note that literature holders of FIG. 9, FIG. 11, and FIG. 13 all have shelf strip panels with the same detailing for attachment to pricing channel as the holder of FIG. 4, and that they would therefore, attach in the same way at 90 degrees to the shelf for viewing of literature placed in them as the holder illustrated in FIG. 4.

In keeping with another objective of the literature holder, it will display literature from slat wall as illustrated in FIG. 5, if cuts as illustrated in FIG. 5 are made from the exterior points where shelf strip panel 12B meets side panel 13B to holes 25A and 25B, and cuts are made from the exterior points where shelf strip panel 12A meets side panel 13A to holes 25C and 25D, and if shelf strips 12B and 12A and are folded outward, as illustrated in FIG. 5, so they are at 90 degrees to sides 13B and 13A, and the shelf strip panels are flexed and inserted in the horizontal undercut opening illustrated by 2 in a flat vertical wall surface as slat wall illustrated by 1, and which shelf strips 12A and 12B lodge under the slat wall surface, leveraging the holder against the vertical surface, so literature as indicated by 11 in the holder, is displayed at 90 degrees to the display surface, and which literature may be replaced or inserted from either the top opening of the holder, 60A, or the bottom opening, 60B.

Note also that literature holders of FIG. 9, FIG. 11, and FIG. 13 all have shelf strip panels with the same detailing for attachment to slat wall as the holder of FIG. 5, and that they would therefore, attach in the same way at 90 degrees to slat wall for viewing of literature placed in them as the holder illustrated in FIG. 5.

In FIG. 6 illustration is made to show how the holder may be attached to peg board as illustrated generally by 39 which is a vertical surface with holes, as illustrated by 40A, which holes are separated by a consistent distance between their horizontal centers, so that when the shelf strip panel 12B is folded at score 18B at 90 degrees to side panel 13B and shelf strip panel 12A is folded at score 18A at 90 degrees to side panel 13A, the holder may be attached to the peg board by passing the shaft of a fastener with a shaft and a broad head, known as a peg, as illustrated by 40B, through holes 26B and 26D in the shelf strips of the literature holder, and into holes as generally illustrated by 40A in the peg board, which fastens the literature holder securely leveraged against the peg board surface so that it displays literature, illustrated by 11, in said holder, at 90 degrees from the peg board, which is conservative of display space and easily seen by people approaching from either direction. Additional pegs may be placed through shelf strip holes illustrated by 26A and 26C into peg board holes if additional fastening is preferred.

Note also that literature holders of FIG. 9, FIG. 11, and FIG. 13 all have shelf strip panels with the same detailing for attachment to peg board as the holder of FIG. 6, and that they would therefore, attach in the same way at 90 degrees to peg board for viewing of literature placed in them as the holder illustrated in FIG. 6.

Figure 2:
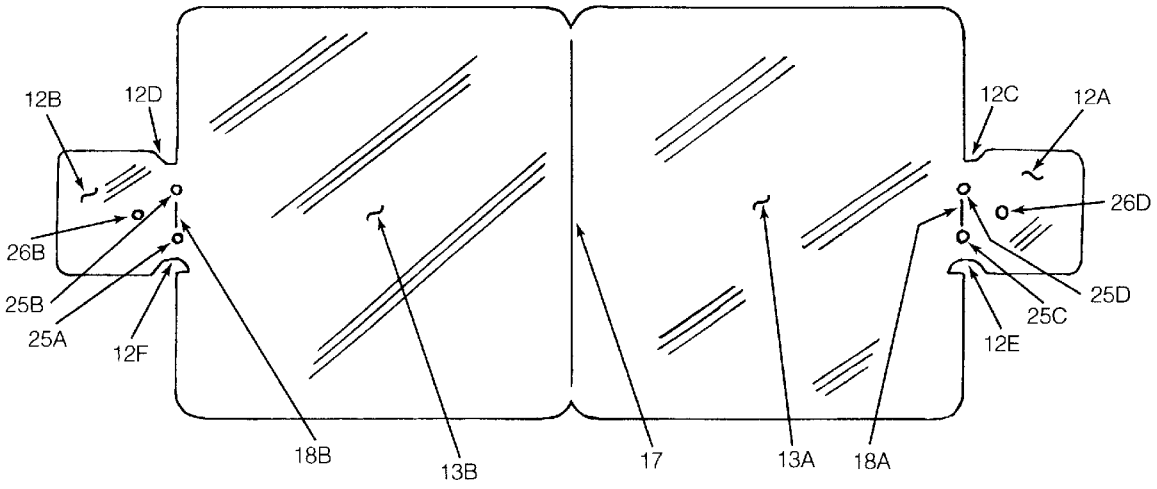
FIG. 2 shows the exterior view of a literature holder blank with one hole in each of the two shelf strip panels, which holes are for attachment of the literature holder to peg board so the holder will display literature at 90 degrees to the peg board surface.
Figure 3:
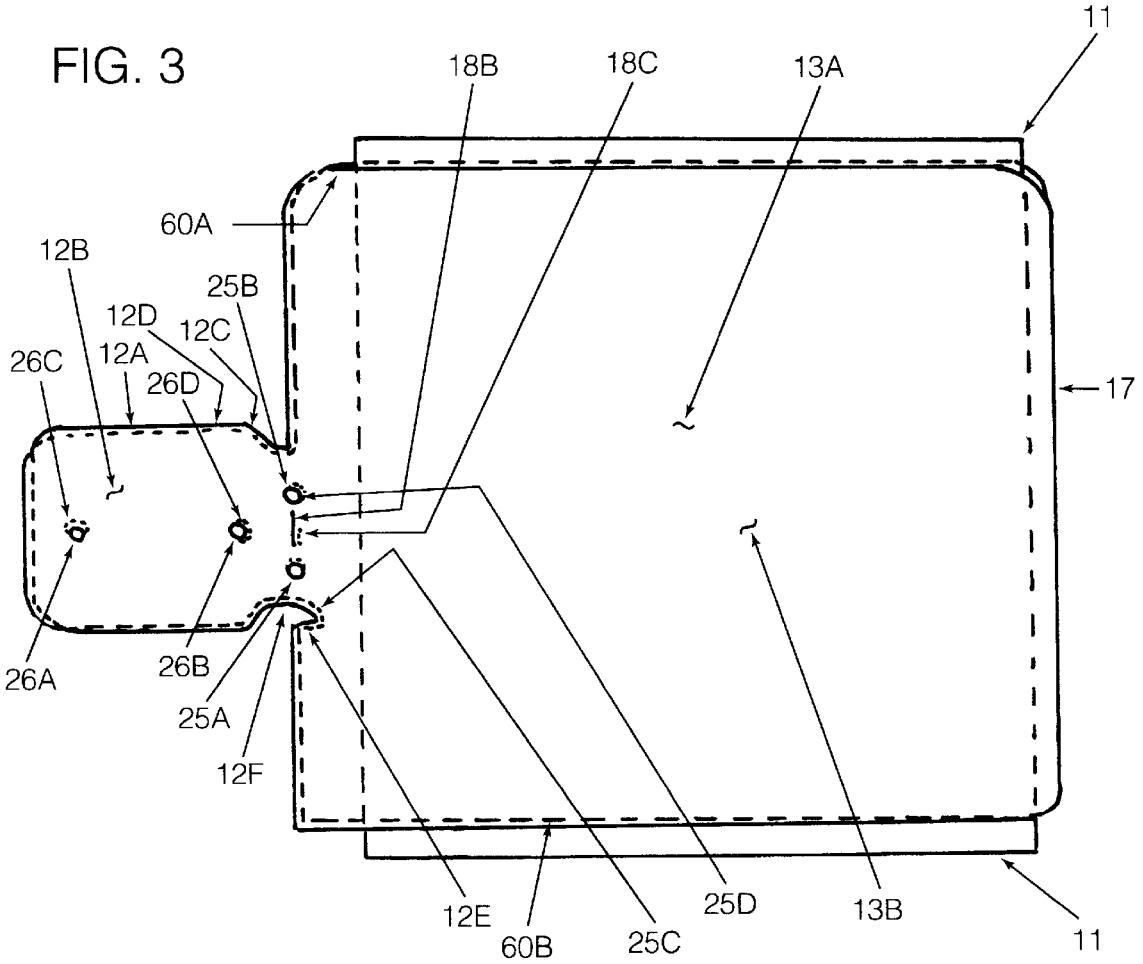
FIG. 3. shows an assembled literature holder, in which a thin piece of literature has been inserted, and which literature extends through a top and a bottom opening in the holder, prior to attachment of the holder to a display surface .

Note that the blank illustrated by FIG. 2 is identical to the blank illustrated in FIG. 1, with the exception that in FIG. 2, the only hole for attachment of a holder assembled from the blank to peg board in shelf strip 12B is hole 26B and the only hole for attachment of a holder assembled from the blank to peg board in shelf strip 12A is 26D. When a peg, as illustrated by 40B in FIG. 6, is passed through each of the shelf strip panel holes 26B and 26D into peg board holes illustrated by 40A, it is generally sufficient to secure the holder assembled from the blank, firmly leveraged to a pegboard surface without the necessity of securing the holder to the peg board surface with pegs through additional holes, which additional holes are illustrated in FIG. 1 and FIG. 6 by 26A and 26C.

FIG. 9 illustrates an objective of the invention to provide a holder which will display one or two thin pieces of literature upright at 90 degrees to the surface to which the literature holder is attached and wherein the literature may be withdrawn or inserted from the top or from the front of the holder. The holder of FIG. 9 is formed from a blank, the interior view of which is illustrated by FIG. 7, made of thin stiff plastic material, cut so it may be folded with the interior sides folding to meet each other, which fold is commonly done with heat applied to the area at which the plastic material is folded to insure upon folding that the material retains it's folded form, and which fold is on an axis illustrated by 17, which causes the side panels, illustrated by 13B and 13A to meet, touching each other, and to remain touching each other after they are folded, as in FIG. 9, with shelf strip panels, 12A and 12B opposite each other; so that in keeping with an objective of the literature holder, one or two thin pieces of literature may be inserted between side panels 13B and 13A if the side panels are parted for insertion of the literature, and if the literature, as illustrated by 11 in FIG. 4, is inserted with one edge close to where the side panels meet at 17, when sides 13B and 13A are released, said sides will again come together, pressing the literature between them with the edge of the literature impinged near where said sides meet at 17, thus holding said literature upright for display at 90 degrees from a display surface, such as the store pricing channel illustrated by 20 in FIG. 4, to which the holder may be attached, or it may be attached to slat wall illustrated by FIG. 5, or attached to peg board as illustrated by FIG. 6.

Figure 7:
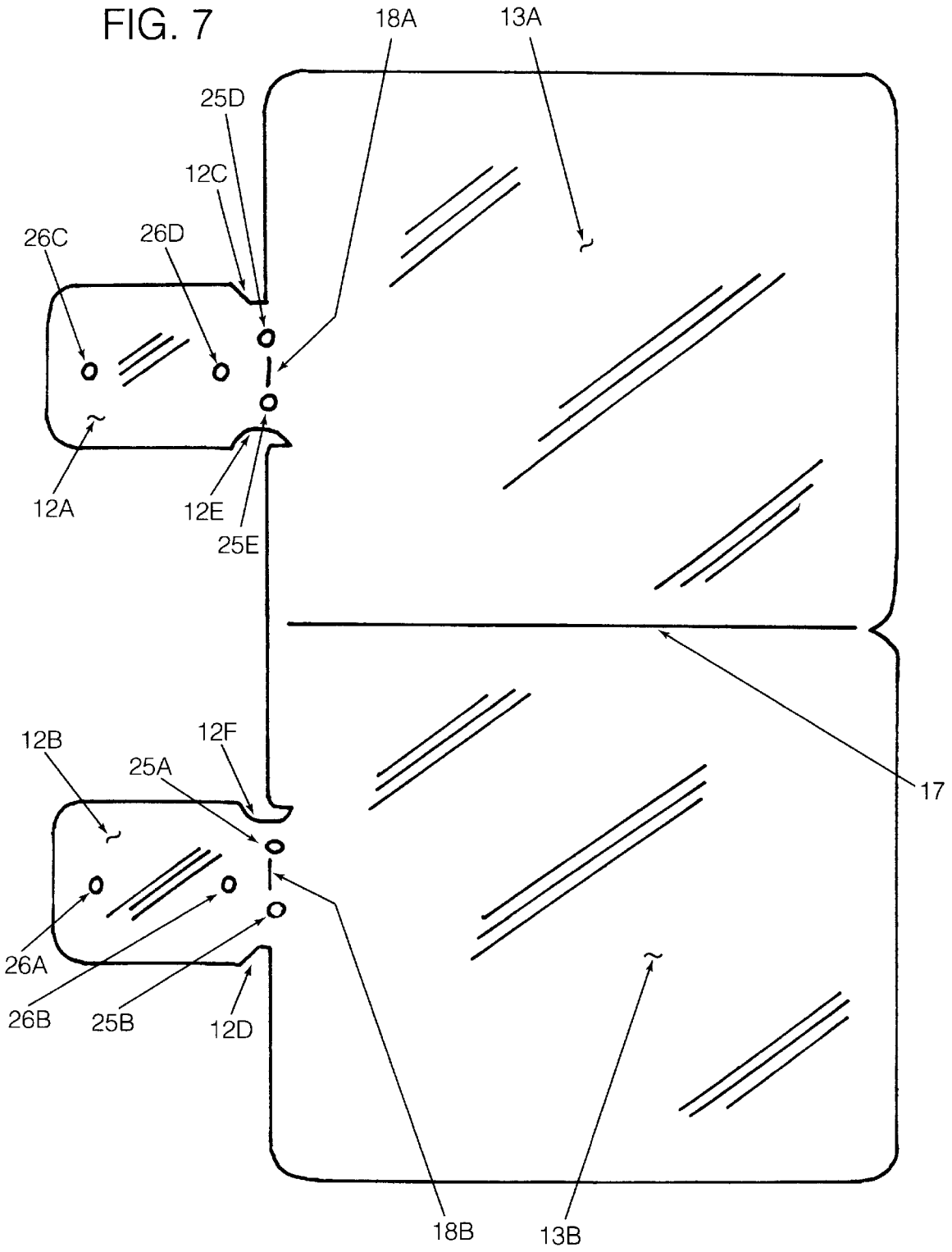
FIG. 7 shows a blank for a literature holder which allows a holder assembled from the blank to hold one or two pieces of thin literature, which literature may be inserted or withdrawn from either the top and or the front openings of the holder.

As illustrated in FIG. 9, literature illustrated by 11, may be of a size that enables it to be grasped at the top opening of the holder, illustrated by 60A, or at the front of the holder, illustrated by 60C, so that if the literature is pulled, it can be removed from the top or from the front of the holder formed from the blank of FIG. 7.

Figure 8:
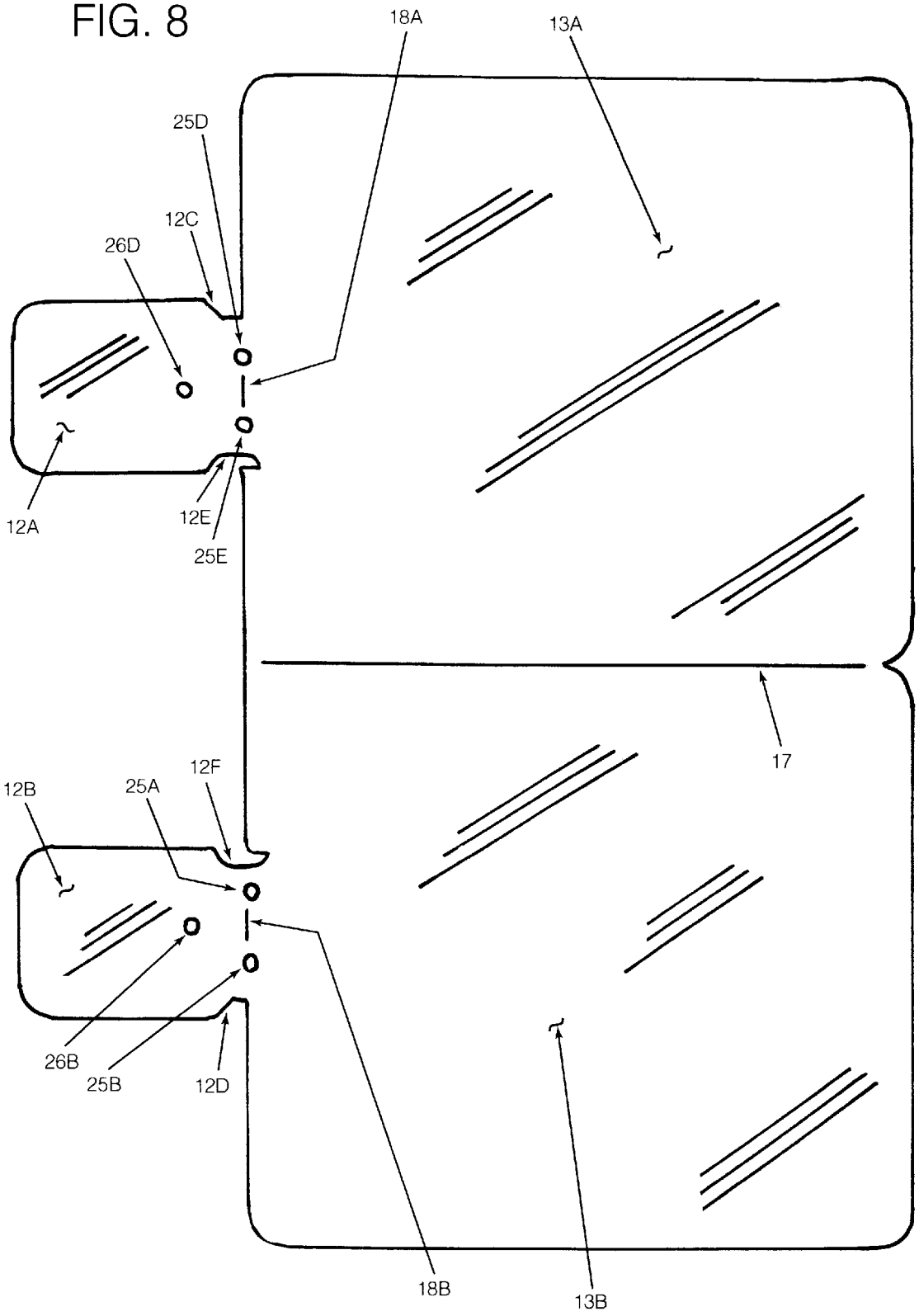
FIG. 8 shows a literature holder blank with one hole in each of the two shelf strip panels, which holes are for attachment of the assembled literature holder to peg board.

Note that the blank illustrated by FIG. 8 is identical to the blank illustrated in FIG. 7, with the exception that in FIG. 8, the only hole for attachment of a holder assembled from the blank to peg board in shelf strip 12B is hole 26B and the only hole for attachment of a holder assembled from the blank to peg board in shelf strip 12A is 26D. When a peg, as illustrated by 40B in FIG. 6, is passed through shelf strip panel holes 26B and 26D into peg board holes illustrated by 40A, it is generally sufficient to secure the holder assembled from the blank, firmly leveraged to a pegboard surface without the necessity of securing the holder to the peg board surface with pegs through additional holes, which additional holes are illustrated in FIG. 7 and FIG. 6 by 26A and 26C.

Figure 10:
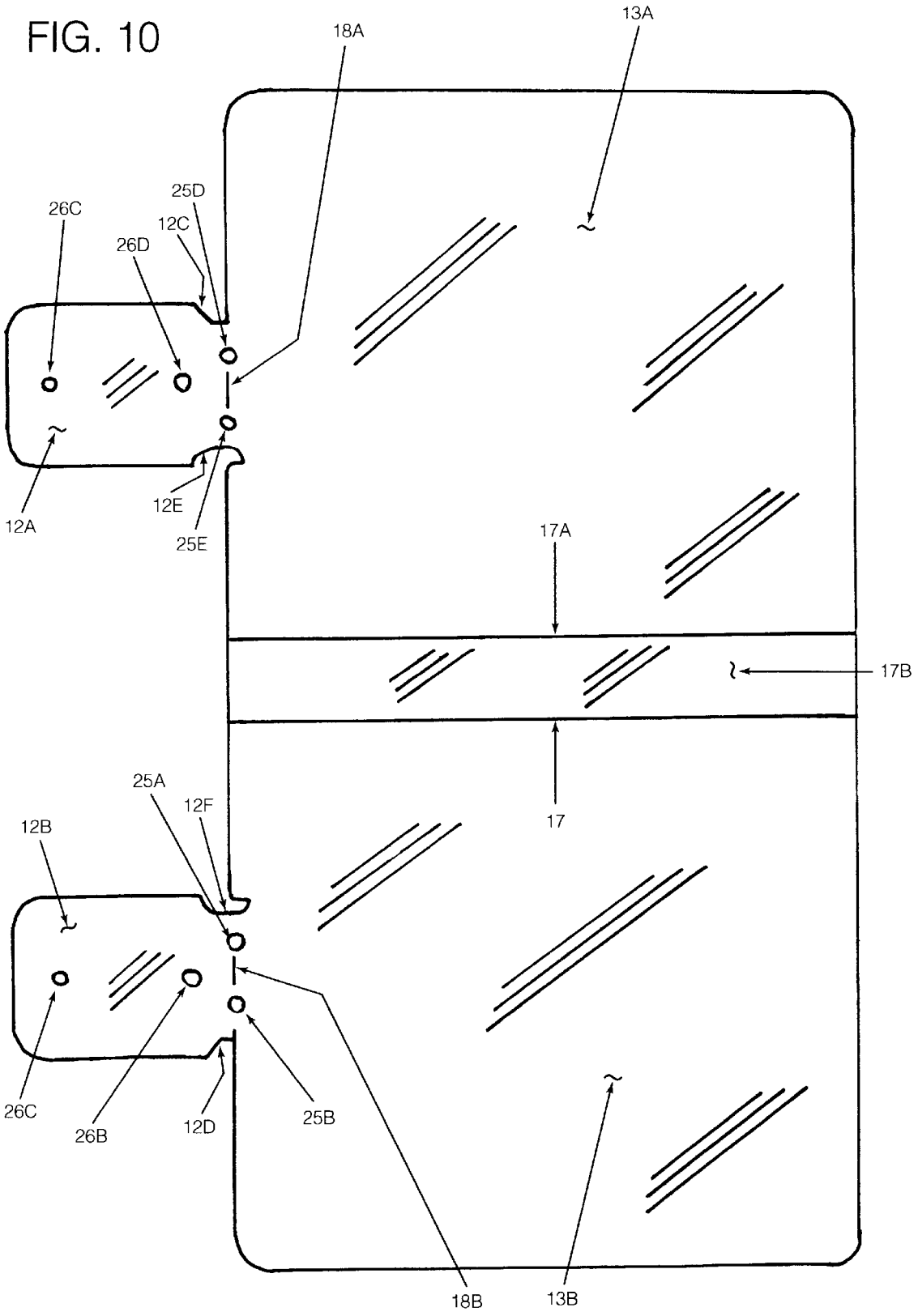
FIG. 10 shows a blank for a literature holder, which holder when assembled, dispenses literature from either the top or from the front of the holder while displaying the literature at 90 degrees from the surface to which it is attached.

In keeping with an objective of the literature holder to dispense literature from the top and from the front of the holder, FIG. 10 illustrates the interior view of a blank as shown in FIG. 7 with the addition of a bottom panel, as illustrated by 17B, which is attached to side panel 13A at 17A, which blank when it is assembled into a literature holder, as illustrated by FIG. 11 will attach to store pricing channel and display literature, illustrated by 11, held in it at 90 degrees to the display surface to which the holder is attached, and to dispense said literature from the top or from the front of said holder.

Note that the shelf strip panels of the blank illustrated in FIG. 10 and the holder illustrated in FIG. 11 have features illustrated in FIGS. 1, 2, 3, 4, 5, 6, 7 and 8 which permit the holder to be attached to slat wall and peg board, as well as pricing channel, for display of literature at 90 degrees to the display surface to which the holder is attached.

An additional objective is to provide a literature holder as illustrated in FIG. 13, shown attached to pricing channel, which said holder is conservative of display space between the surface to which it is attached and the extremity of the holder opposite the surface to which the holder is attached. Literature, illustrated by 11, is displayed in the holder upright at 90 degrees to the surface to which the holder is attached.

Figure 12:
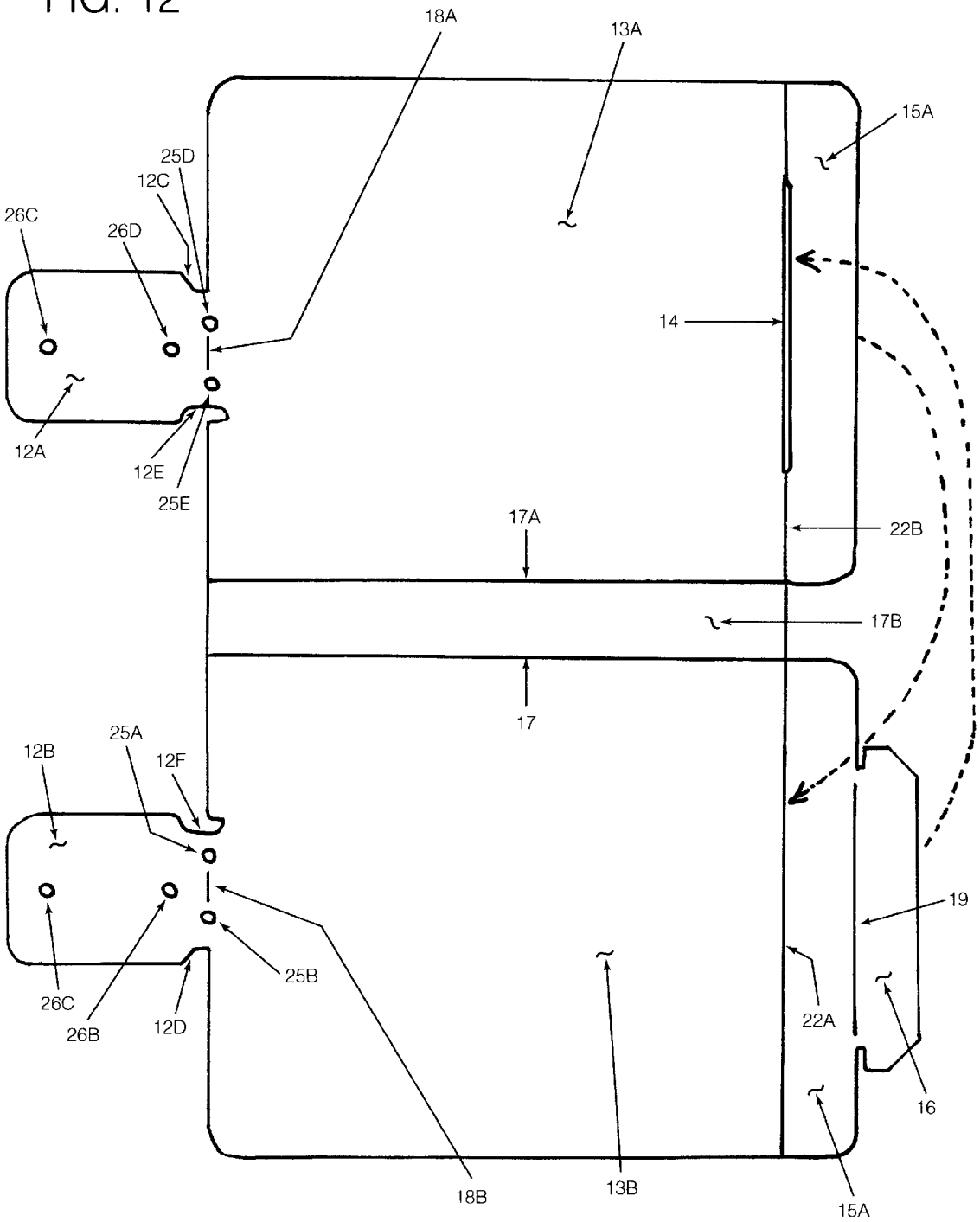
FIG. 12 shows a blank for a literature holder which when assembled, will display literature at 90 degrees from a display surface in a manner conservative of space between the display surface and the termination of the holder at 90 degrees to the surface.

Turning to FIG. 12, the interior view of a blank is illustrated, which blank when side 13B is folded upward along score 17, so it is at 90 degrees to bottom panel 17B, and side 13A is folded upward along score 17A, so it is at 90 degrees to bottom panel 17B, end panel 15B is in position to be folded on score 22B so that panel 15B is 90 degrees to side panel 13A, so that when panel 15A is folded toward 15B so as to overlap it, and be positioned at 90 degrees to side panel 13B, the male lock illustrated by 16, which is attached to panel 15A along score 19, may be engaged in the cut opening illustrated by 14 between side panel 13A and panel 15B, which acts as a female lock, which fastening with male lock 16, results in the end of the literature holder being securely locked in place with panels 15B and 15A overlaped, and which panels 15B and 15A are both the same width as bottom panel 17B, which results in a literature holder conservative of space between the surface to which it is attached and the extremity of the holder opposite that surface, and which holder displays literature at 90 degrees to the display surface to which the holder is attached which is conservative of display space and which literature displayed in the holder may be seen by people approaching from either direction.

Thus it can be seen that a literature holder and blank therefore, for displaying literature at 90 degrees to the display surface to which it is attached, may display one or two pieces of literature and which literature which can be withdrawn or inserted from either the top or from the bottom of the holder, and which blank for said holder is economical of material required to make it; and that a literature holder and blank therefore, for displaying literature at 90 degrees to the display surface to which it is attached, may display one or two pieces of literature which can be withdrawn or inserted from either the top or from the front of the holder, and which blank for said holder is economical of material required to make it; and that a literature holder and blank therefore with a bottom panel, for displaying literature at 90 degrees to the display surface to which it is attached, may display literature which can be withdrawn from either the top or from the front of the holder; and that a literature holder and blank therefore with a bottom panel, for displaying literature at 90 degrees to the display surface to which it is attached, and two overlapping end panels secured by a lock, may display literature at 90 degrees to a display surface in a way which is economical of display space between the surface to which the holder is attached and the extremity of the holder opposite said surface. While the invention has been described in terms of a preferred embodiment, it is not intended to limit the invention to the same, but to include all equivalents and modifications within the scope of the claims to follow.

What is claimed is:

1. A substantially flat, die cut and scored blank made of stiff material, for assembling into a holder for literature, comprising in combination, two die cut shelf strip panels, each having an angled cut on one side, and a cut shaped like the round edge of a store shelf, on the opposite side, with two holes cut in each of said shelf strip panels, each of said respective two holes being located inward from the opposite sides of their shelf stip panel at where a respective said shelf strip panel meets a side panel, at a point where cuts can be made to each of the four holes from the exterior of the shelf strip panels where they join said side panels, to a point where when the cuts are made, the shelf strip panels may be flexed for insertion in a horizontal opening in a vertical surface, which opening is provided for attachment of objects to the surface, so that when said shelf strip panels are inserted in the opening they will hold the literature holder leveraged against the surface with a narrow profile of the holder at a 90 degree angle to the surface; and with additional holes in each of the shelf strip panels, the horizontal centers of said additional holes in each of the two shelf strip panels, when the literature holder is assembled from the blank, are separated and which horizontal distance between their centers is the horizontal distance between the center of corresponding holes in a pegboard, which is commonly used for display surface, and which pegboard holes are consistently spaced, whereby the shaft of a friction fit fastener, which shaft is attached to a broad flat bead, can pass through each of the said additional holes in the shelf strip panels into the pegboard, leveraging a literature holder securely against the surface to which it has been attached with the narrow profile positioning the holder at 90 degrees to the surface; and two rectangular side panels, for holding literature in the holder upright when the holder is assembled from the blank, attached to and adjoining the two shelf strip panels and which said side panels meet together at a common axis midway between the opposing sides of the side panels to which the shelf strip panels are joined to said side panels, wherein the improvement comprises the ability of said blank to be folded with said side panels folded along their common axis so they meet and remain touching each other, so literature may be placed between said side panels when said panels are held apart to accept the literature, the literature will be secured when the side panels are released to resume contact with each other, the literature being pressed between said side panels and which literature is also held in place by the narrowness of the common axis where the panels meet, which narrow juncture impinges on the literature placed with the edge of the literature in said juncture, so that literature held in the holder will be displayed in an upright position at 90 degrees to the surface to which the literature holder is attached, providing said narrow profile and provides openings at both the top and at the bottom of the holder for insertion and withdrawal of literature.

2. A substantially flat, die cut and scored blank made of stiff material, for assembling into a holder for literature, comprising in combination, two die cut shelf strip panels, each having an angled cut on one side, and a cut shaped like the round edge of a store shelf, on the opposite side, with two holes cut in each of said shelf strip panels, each of said respective two holes being located inward from the opposite sides of their shelf strip panel at where said shelf strip panel meets a side panel, at a point where cuts can be made to each of the four holes from the exterior of the shelf strip panels where they join said side panels, to a point where when the cuts are made, the shelf strip panels may be flexed for insertion in a horizontal opening in a vertical surface, which opening is provided for attachment of objects to the surface, so that when said shelf strip panels are inserted in the opening they will hold the literature holder leveraged against the surface with a narrow profile of the holder leveraged against the surface with the narrow profile positioning the holder at a 90 degree angle to the surface; and with additional holes in both of the shelf strip panels, the horizontal centers of said addition holes in each of the two shelf strip panels, when the literature holder is assembled from the blank, are separated and which horizontal distance between their centers is the horizontal distance between the center of corresponding holes in a pegboard, which pegboard is commonly used for a display surface, and which the pegboard holes are consistently spaced, whereby the shaft of a friction fit fastener, which shaft is attached to a broad flat bead, can pass through each of the said holes in the shelf strip panels into the pegboard, leveraging a literature holder securely against the surface to which it has been attached with a narrow profile positioning the holder at 90 degrees to the surface; and two rectangular side panels, for holding literature in the holder upright when the holder is assembled from the blank form, attached to and adjoining the two shelf strip panels, wherein the improvement comprises the side panels being joined along a common axs which positions the shelf strip panels which are attached to said side panels on the same side of the blank, with the cut in each of the shelf strip panels, which is shaped like the round metal edge of a retail store's pricing channel, facing each other, and with the shelf strip panels positioned so that when said side panels are folded along their common axis so they meet, and remain touching each other, said shelf strip panels will also be touching, with the die cuts of said shelf strip panels matched together in the same position mirrored opposite each other, said improvement permits literature to be placed between said two side panels when said side panels are separated for insertion of the literature and wherein the literature is held firmly in an upright position between said side panels when said side panels resume contact with each other, pressing literature which may have been inserted between them firmly between said side panel, and with the edge of the literature placed close to the narrow juncture of the axis where said two side panels meet, so that said narrow juncture will impinge on the literature, holding it in place so that when the literature holder assembled from the blank is leveraged at a display surface, the literature is held upright with the narrow profile of the holder at a 90 degree angle to the surface, and which literature may be replaced from either the top, or from the front of the holder, which front is opposite the side of the holder which may be attached to a display surface.

3. The blank described in claim 2 wherein the improvement further comprises side panels being separated along their common axis by a rectangular bottom panel which bottom panel extends between said side panels from between said two shelf strip panels, on the side to which the shelf strip panels are attached, to the opposite side of the blank, so that when said side panels of the blank are folded upward at 90 degrees toward each other along where they meet the bottom panel, the shelf strip panels attached to each said side panel will be opposite each other with the angled cut of each said shelf strip panel facing up and the cut shaped like the round edge of a retail store's pricing channel of each said shelf strip panel facing down, so that the holder formed from the assembled blank may be attached to a display surface, so literature which may be placed in the holder is supported by said bottom panel of the holder assembled from the blank and the literature will be held in an upright position by the side panels, at a 90 degree angle to the display surface to which the holder is attached, which improvement permits dispensing of the literature from either the open top or open end of the holder assembled from the blank.

4. The blank described in claim 3 wherein the improvement future comprises the addition of two rectangular end flap panels, each said end flap panel being attached to one of the two side panels by a score, and which said end flap panels extend along the side of each said side panel to which it is attached, which is the side opposite the side of said side panels to which the shelf strip panels are attached, and which said end flap panels extend from the edge of each said side panel and terminate where each end flap panels meets the bottom panel, and one said end flap panel adjoins a female lock where said end flap panels with the respective side panel, and the other end flap has a male tab lock attached to it by a score on the side of the end flap panel opposite the side to which said end flap panel is attached to the side panel, so that when said sides of the holder formed from the blank are folded upward toward each other at 90 degrees from the bottom panel, the two said end flap panels may be folded with the end flap panel with said male tab lock attached to it overlapping the end flap panel flap which has the female lock, so that said male tab lock may be engaged in said female lock, providing a securely locked holder, and which said overlapping end panels, which when they are locked in place, hold the side panels apart by a distance equal to the width of the bottom panel, providing a secure literature holder formed from the blank, which holder extends at 90 degrees from said surface.

5. A holder for literature made of stiff material, comprising in combination, two die cut shelf strip panels, each having an angled cut on one side, and a cut shaped like the round edge of a store shelf, on the opposite side, with two holes cut in each of said shelf strip panels, each of said respective two holes being located inward from the opposite sides of their strip panel where the a respective shelf strip panel meets a side panel, at a point where cuts can be made to each of the four holes from the exterior of the shelf strip panels where they join the side panels, to a point where when the cuts are made, the shelf strip panels may be flexed for insertion in a horizontal opening in a vertical surface, which opening is provided for attachment of objects to the surface, so that when shelf strip panels are inserted in the opening they will hold the literature holder leveraged against the surface with the a narrow profile of the holder leveraged against the surface, with the narrow profile of the holder at a 90 degree angle to the surface; and with additional holes in each of the shelf strip panels, the horizontal centers of said addition holes in each of the two shelf strip panels are separated, and the horizontal distance between their centers is the horizontal distance between the centers of corresponding holes in a pegboard, which pegboard is commonly used for a display surface, and which pegboard holes are consistently spaced, whereby the shaft of a friction fit fastener, which shaft is attached to a broad flat bead, can pass through each of the said additional holes in the shelf strip panels into the pegboard, leveraging the literature holder securely against the surface to which it has been attached with the narrow profile positioning the holder at 90 degrees to the surface; and two rectangular side panels, for holding literature in the holder upright, attached to and adjoining the two shelf strip panels and which said side panels meet together at a common axis midway between the opposing sides of the side panels to which the shelf strip panels are joined to said side panels, wherein the improvement comprises the ability of said holder to be folded with said side panels folded along their common axis so they meet, and remain touching each other, so literature may be placed between said side panels when said panels are held apart to accept the literature, the literature will be secured when the side panels are released to resume contact with each other, the literature being pressed between said side panels and which literature is also held in place by the narrowness of the common axis where the panels meet, which narrow juncture impinges on the literature placed with the edge of the literature in said juncture, so that literature held in the holder will be displayed in an upright position at 90 degrees to the surface to which the literature holder is attached, providing a said narrow profile and provides openings at both the top and at the bottom of the holder for insertion and withdrawal of literature.

6. A holder for literature made of stiff material, comprising in combination, two die cut shelf strip panels, each having an angled cut on one side, and a cut shaped like the round edge of a store shelf, on the opposite side, with two holes cut in each of said shelf strip panels, each of said respective two holes being located inward from the opposite sides of their shelf strip panel at where said shelf strip panel meets a side panel, at a point where cuts can be made to each of the four holes from the exterior of the shelf strip panels where they join said side panels, to a point where when the cuts are made, the shelf strip panels may be flexed for insertion in a horizontal opening in a vertical surface, which opening is provided for attachment of objects to the surface, so that when said shelf strip panels are inserted in the opening they will hold the literature holder leveraged against the surface with a narrow profile of the holder leveraged against the surface with the narrow profile positioning the holder at a 90 degree angle to the surface, which presents literature which may be held in the literature holder for viewing by people from either direction; and with addition holes in both of the shelf strip panels, the horizontal centers of said additional holes in each of the two shelf strip panels are separated, and which the horizontal distance between their centers is the horizontal distance between the center of corresponding holes in a pegboard, which pegboard is commonly used for a display surface, and the pegboard holes are consistently spaced, whereby the shaft of a friction fit fastener, which shaft is attached to a broad flat bead, can pass through each of the said additional holes in the shelf strip panels into the pegboard, leveraging the literature holder securely against the surface to which it has been attached with the narrow profile positioning the holder at 90 degrees to the surface and two rectangular side panels, for holding literature in the holder upright, attached to and adjoining the two shelf strip panels, wherein the improvement comprises the side panels of the holder being joined along a common axis with the shelf strip panels attached to said side panels above said axis, with the cut in each of the shelf strip panels which is shaped like the round metal edge of a retail store's pricing channel facing down so that said side panels which are folded along their common axis so they meet, and remain touching each other, said shelf strip panels also touch each other with the die cuts of said shelf strip panels matched together in the same position mirrored opposite each other, which improvement permits literature to be placed between said two side panels when said side panels are separated for insertion of the literature and wherein the literature is held firmly in an upright position between side panels when said side panels resume contact with each other, pressing literature which may have been inserted between them firmly together said side panels, and with the edge of the literature placed close to the narrow juncture of the axis where said two side panels meet, so that said narrow juncture will impinge on the literature, holding it in place so that when the literature holder is leveraged against a display surface, the literature is held upright with the narrow profile of the holder at a 90 degree angle to the surface, and which literature may be replaced from either the top, or from the front of the holder, which front is opposite the side of the holder which may be attached to a display surface.

7. The holder described in claim 6 wherein the improvement further comprises said of the side panels being separated along their common axis by a rectangular bottom panel, which bottom panel extends between side panels from the side of said side panels to which they are joined to said shelf strip panels, to the opposite side of the holder, so that the side panels of the holder, which are 90 degrees to said bottom panel and the shelf strip panels attached to each said side panel are opposite each other with the angled cut of each said shelf strip panel fling up and the cut shaped like the round edge of a retail store's pricing channel of each said shelf strip panel facing down, so that the holder may be attached to a display surface, and literature which may be placed in the holder will be supported by said bottom panel of the holder, and the literature will be held in an upright position by said side panels, at a 90 degree angle to the display surface to which the holder is attached, and which said improvement permits dispensing of the literature from either the open top or open end of the holder.

8. The holder described in claim 7 wherein the improvement further comprises the addition of two rectangular end flap panels, each said end flap panel being attached to one of the two side panels by a score, and which said end flap panels extend along the side of each said side panel to which it is attached, which is the side opposite the side of said side panels to which the shelf strip panels are attached, and which said end flap panels extend from the edge of each said side panel and terminate where each end flap panel meets the bottom panel, and one said end flap panel adjoins a female lock where said end flap panel joins with the side panel, and the other end flap panel has a male tab lock attached to it by a score on the side of the end flap panel opposite the side to which said end flap panel is attached to the side panel, so that said sides of the holder which are positioned at 90 degrees from the bottom panel, permit the two said end flap panels to be folded with the end flap panel with said male tab lock attached to it overlapping the end flap panel flap which has the female lock, so that said male tab lock may be engaged in said female lock, providing a securely locked holder, and which said overlapping end panels, which when they are locked in place, hold the side panels apart by a distance equal to the width of the bottom panel, providing a secure literature holder, and which holder extends at 90 degrees from a display surface.

* * * * *